US006155851A

United States Patent [19]

Kazuhara

[11] Patent Number: 6,155,851

[45] Date of Patent: Dec. 5, 2000

[54] CONNECTOR LOCKING STRUCTURE

[75] Inventor: Hitoshi Kazuhara, Shizuoka, Japan

[73] Assignee: Yazaki Corporation, Tokyo, Japan

[21] Appl. No.: 09/456,908

[22] Filed: Dec. 7, 1999

[30] Foreign Application Priority Data

Dec. 21, 1998 [JP] Japan ..... 10-363239

[51] Int. Cl.[7] ..... H01R 13/62

[52] U.S. Cl. ..... 439/157

[58] Field of Search ..... 439/347, 310, 439/152–160

[56] References Cited

U.S. PATENT DOCUMENTS

| | | | |
|---|---|---|---|
| 4,586,771 | 5/1986 | Kraemer et al. | 339/75 MP |
| 5,618,194 | 4/1997 | Maue et al. | 439/157 |
| 5,899,762 | 5/1999 | Ainceri | 439/157 |
| 5,902,141 | 5/1999 | Iwahori | 439/157 |
| 5,928,013 | 7/1999 | Iwahori | 439/157 |
| 6,036,509 | 3/2000 | Maejima | 439/157 |
| 6,045,375 | 4/2000 | Aoki et al. | 439/157 |
| 6,062,882 | 5/2000 | Hanazaki et al. | 439/157 |
| 6,065,982 | 5/2000 | Okabe | 439/157 |
| 6,077,097 | 6/2000 | Kumakura et al. | 439/157 |
| 6,083,017 | 7/2000 | Matsumura | 439/157 |

*Primary Examiner*—Renee Luebke
*Assistant Examiner*—Phuongchi Nguyen
*Attorney, Agent, or Firm*—Sughrue, Mion, Zinn, Macpeak & Seas, PLLC

[57] ABSTRACT

In a connector locking structure in which engaging projections 11 are provided on a male connector housing 10, insertion grooves 25 through which the engaging projections 11 are inserted are provided in a hood portion 21 of a female connector housing 20 with respect to which the male connector housing 10 is engaged or disengaged, and a slide member 30 having a flexible retaining projection 34 engaging with the engaging projections 11 is provided on the hood portion 21 of the female connector housing 20 in such a manner as to be movable by a pressing operation of an operating portion 31, so as to lock a fitted state of the two connector housings 10 and 20 by engagement between the flexible retaining projection 34 of the slide member 30 and the engaging projections 11 of the male connector housing 10, a connector-disengaging tapered surface 36 is provided on the slide member 30, while a canceling projection 14 which is slid on the tapered surface 36 is provided on the male connector housing 10 at a position opposing the tapered surface 36.

2 Claims, 9 Drawing Sheets

CONNECTOR LOCKING STRUCTURE

BACKGROUND OF INVENTION

1. Field of Invention

The present invention relates to a connector locking structure in which a slide member having a flexible retaining projection is provided on a female connector housing, and the fitted state of male and female connector housings can be locked or canceled by the moving operation of the slide member.

2. Related Art

Conventionally, as shown in FIG. 14, in a connecting structure for connecting a male connector 101 on the wire harness side and a female connector 105 on the equipment side, a lock arm 103 is provided on a male connector housing 102 formed of synthetic resin in such a manner that the lock arm 103 is formed integrally with the male connector housing 102 and, similarly, an engaging projection 107 corresponding to the lock arm 103 is provided on a female connector housing 106, whereby the two male and female connectors 101 and 105 are fitted with and locked to each other.

Especially, since a heat resistance property must be given to the female connector housing 106 on the equipment side, the lock arm 103, which is highly flexible, in most cases, cannot be formed of heat-resisting resin. Also, when the lock arm 103 is provided on the female connector housing 106 on the equipment side, the efficiency of an operation when removing the locked condition of the male and female connectors 101 and 105 is poor. This is the reason why the lock arm 103 including a removal operation portion 104 is provided on the male connector 101 on the wire harness side.

However, in the above-mentioned conventional connecting structure, since the lock arm 103 projects from the male connector housing 102, the male connector 101 is enlarged in size to thereby increase the size of the whole connector; and, because the lock arm 103 can be easily interfered, there is a fear that the locked condition of the fitting engagement between the two male and female connectors 101 and 105 can be removed inadvertently.

SUMMARY OF INVENTION

Accordingly, the present invention has been devised to overcome the above-described problems, it is an object of the invention to provide a small-sized connector locking structure in which not only the operation of an operation portion of a slide member mounted on a female connector housing can be executed smoothly, but also the locking and unlocking of the fitting engagement between two male and female connector housings can be executed easily and positively. Another object is to provide a connector locking structure which is capable of reliably preventing damage to the engaging projection of the male connector housing and which makes it possible to disengage the male connector housing smoothly from inside the hood portion of the female connector housing by improving the operationality in returning the slide member, by moving the slide member from the fitted state of the male and female connector housings to disengage the two connector housings from each other by a fixed amount and by subsequently returning the slide member to its original position while withdrawing the male connector housing.

According to first aspect of the present invention, there is provided a connector locking structure in which engaging projections are provided on a male connector housing, insertion grooves through which the engaging projections are inserted are provided in a hood portion of a female connector housing with respect to which the male connector housing is engaged or disengaged, and a slide member having a flexible retaining projection engaging with the engaging projections is provided on the hood portion of the female connector housing in such a manner as to be movable by a pressing operation of an operating portion, so as to lock a fitted state of the two connector housings by engagement between the flexible retaining projection of the slide member and the engaging projections of the male connector housing, characterized in that a connector-disengaging tapered surface is provided on the slide member, while a canceling projection which is slid on the tapered surface is provided on the male connector housing at a position opposing the tapered surface.

In this connector locking structure, when the male connector housing is disengaged from the hood portion of the female connector housing, the canceling projection of the male connector housing slides on the connector-disengaging tapered surface of the slide member, so that damage to the fitting/locking engaging projections of the male connector housing can be prevented reliably.

According to an second aspect of the present invention, in the connector locking structure according to the first aspect of the present invention, a tapered surface which slides while coming into surface contact with the tapered surface of the slide member is formed on the canceling projection at a position opposing the tapered surface of the slide member at substantially the same angle of inclination as that of the tapered surface of the slide member.

In this connector locking structure, since the tapered surface which slides while coming into surface contact with the connector-disengaging tapered surface of the slide member is formed on the canceling projection of the male connector housing, the operationality in returning the slide member can be improved, and the male connector housing can be smoothly disengaged from inside the hood portion of the female connector housing.

BRIEF DESCRIPTION OF DRAWINGS

FIG. 2(*b*) is a cross-sectional view of the two connector housings at the time of fitting;

FIG. 3(*b*) is an explanatory diagram illustrating the relationship between a canceling projection of the male connector housing and a tapered surface of a slide member at the time of fitting;

FIG. 4(*b*) is an explanatory diagram illustrating the relationship between the canceling projection of the male connector housing and the tapered surface of the slide member immediately before fitting;

FIG. 5(*b*) is an explanatory diagram illustrating the relationship between the canceling projection of the male connector housing and the tapered surface of the slide member in the process of disengagement

FIG. 11(*b*) is a front elevational view thereof;

FIG. 11(*c*) is a side elevational view thereof;

FIG. 12(*b*) is a bottom view of that slide member;

DETAILED DESCRIPTION OF PREFERRED EMBODIMENTS

Figure 1:
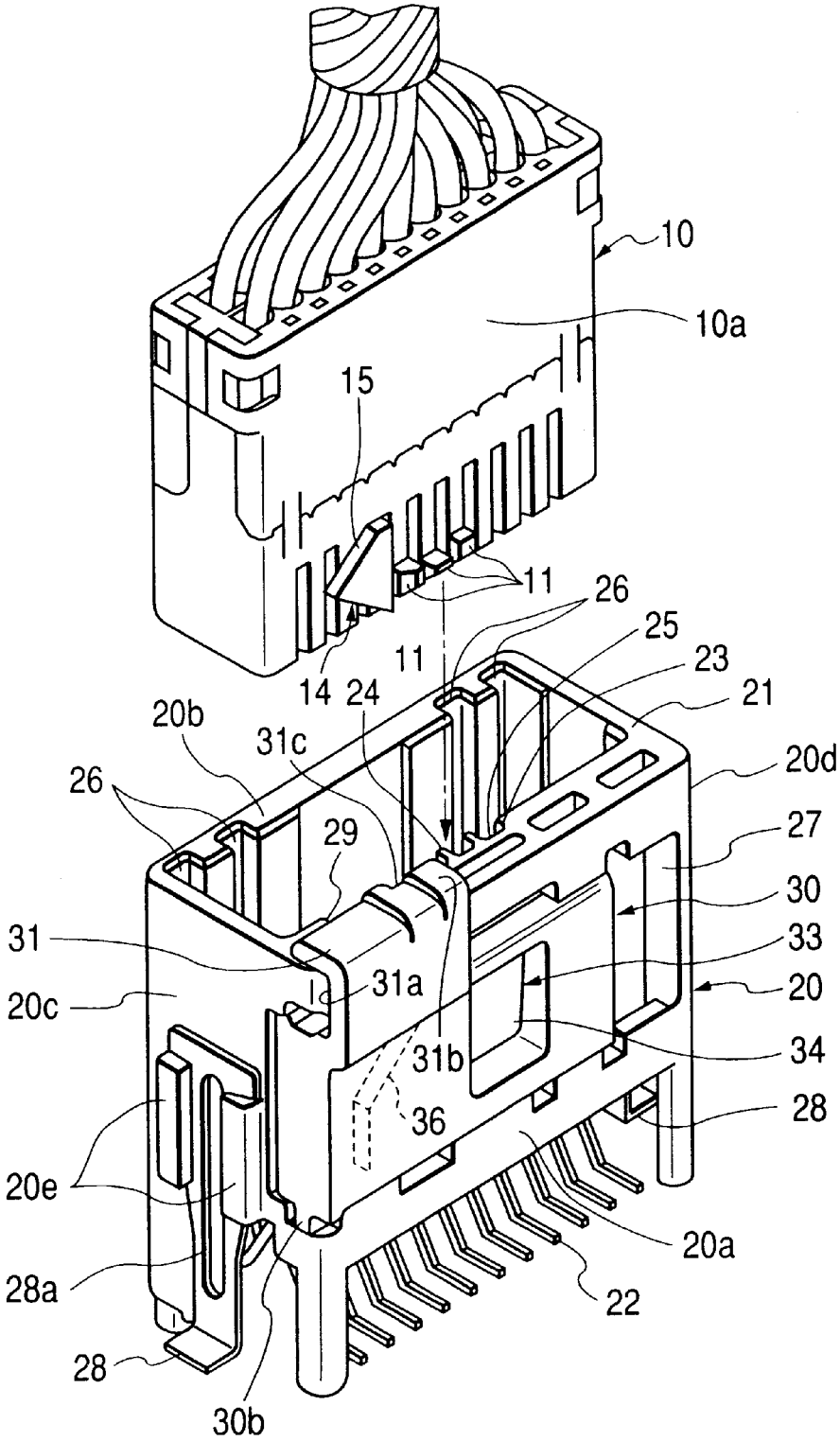
FIG. 1 is a perspective view illustrating a connector locking structure in a state before the fitting of male and female connector housings in accordance with an embodiment of the present invention.

Hereafter, a description will be given of an embodiment of the present invention with reference to the drawings.

First Embodiment

A detailed description will be given of a first embodiment of the present invention this lock structure with reference to FIGS. 6 to 13. In the aforementioned lock structure, engaging projections 11 are provided on a male connector housing 10 on the wire harness side, while insertion grooves 25, through which the aforementioned engaging projections 11 are inserted, are provided in a hood portion 21 of a female connector housing 20 on the apparatus side (substrate side) with respect to which the male connector housing 10 is engaged or disengaged, and a slide member 30, which has flexible retaining projections 34 for engaging with the aforementioned engaging projections 11, is also provided on the hood portion 21 of the female connector housing 20 in such a manner as to be movable by a pressing operation of an operating portion 31. As the flexible retaining projections 34 of the slide member 30 and the engaging projections 11 of the male connector housing 10 are engaged with each other, the fitting state of the two connector housings 10 and 20 is locked.

Figure 6:
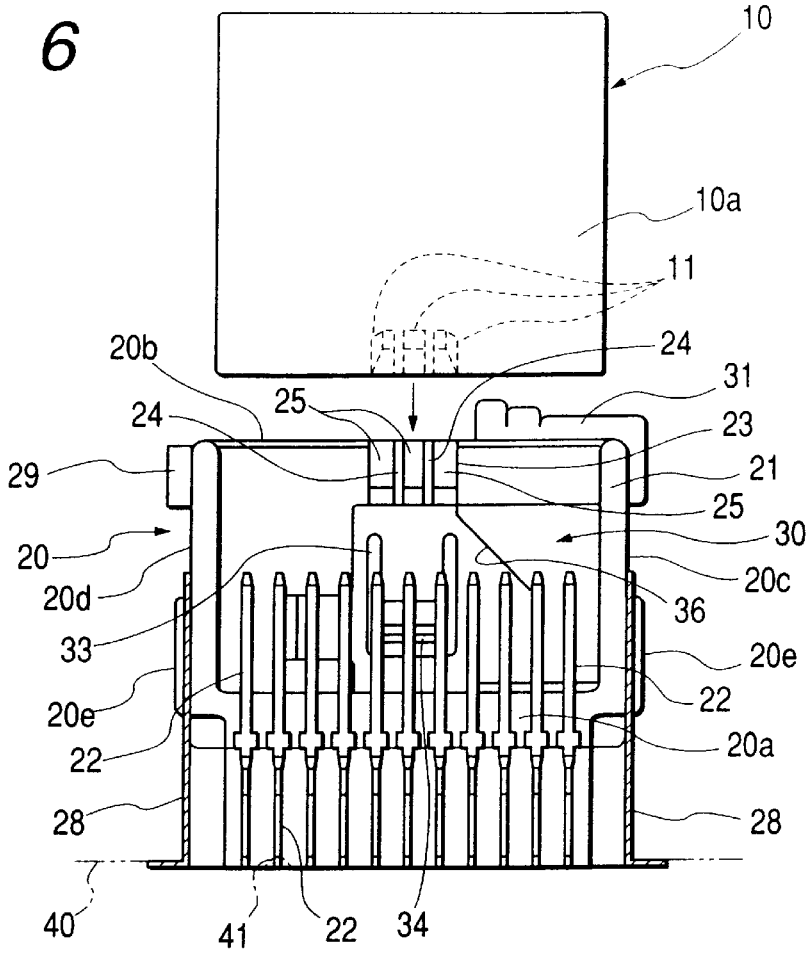
FIG. 6 is an explanatory diagram illustrating a connector locking structure in a state before the fitting of the male and female connector housings in accordance with a first embodiment of the present invention.
Figure 8:
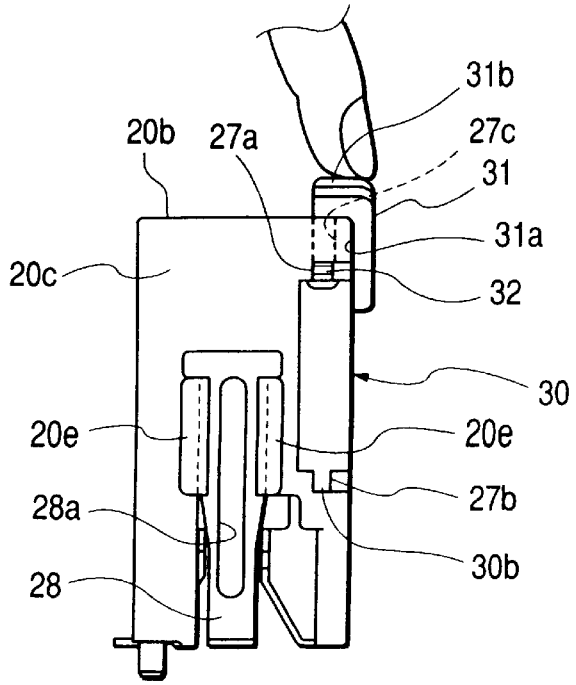
FIG. 8 is a side elevational view of the female connector housing of the present invention.
Figure 11A:
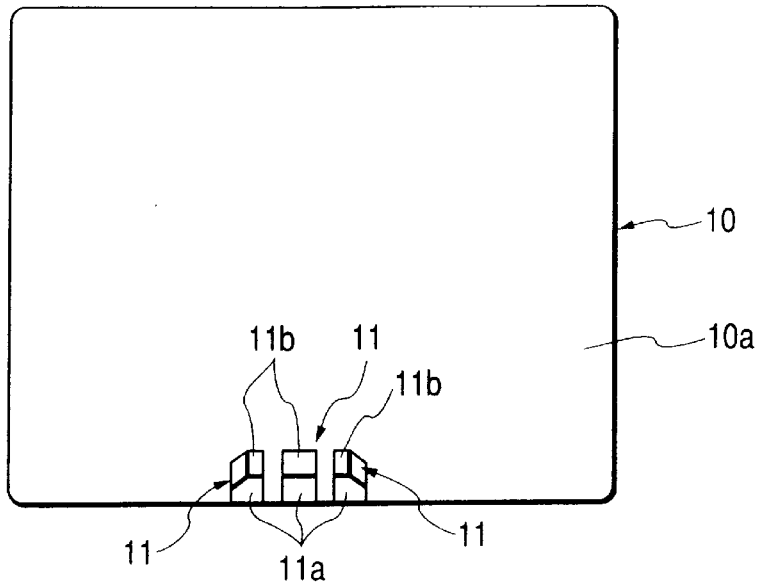
FIG. 11(*a*) is a plan view of the male connector housing of the present invention.
Figure 11B:
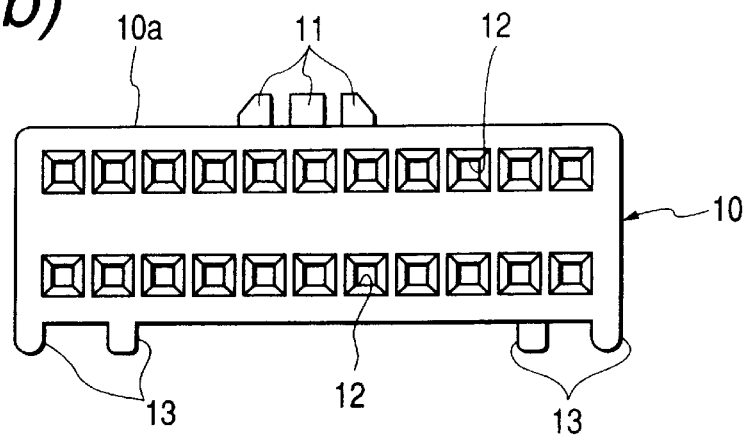
Figure 11C:
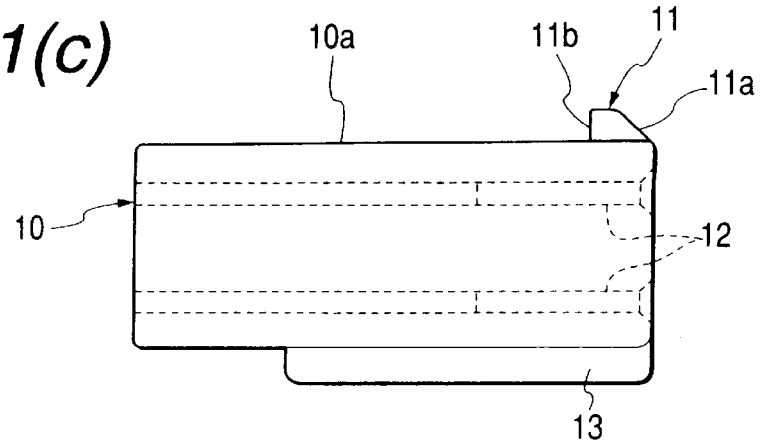

As shown in FIG. 6 and FIGS. 11(*a*), 11(*b*), and 11(*c*), the male connector housing 10 is formed of a synthetic resin in a block shape, and the three engaging projections 11 are integrally formed projectingly at the center of the front side of its upper surface 10*a* at equal intervals. Front surfaces of the engaging projections 11 are formed as inclined surfaces 11*a*, and rear surfaces are formed as inversely inclined surfaces 11*b* close to vertical surfaces. In addition, corner portions on the rear outer sides of the left and right engaging projections 11 are respectively cut away. As shown in FIGS. 11(*b*) and 11(*c*), a plurality of terminal accommodating chambers 12 in two upper and lower stages are formed in the male connector housing 10, and female terminals (not shown) are accommodated in the respective terminal accommodating chambers 12. Electrical wires (not shown) constituting a wire harness are connected to the respective female terminals. Further, two pairs of leg portions 13 are integrally formed projectingly on both sides of the bottom surface of the female connector housing 20.

As shown in FIGS. 6 to 10, the female connector housing 20 is formed of a synthetic resin, and the hood portion 21 of a quadrangular tubular shape, which serves as a connector fitting chamber, is formed on the front side thereof. A plurality of male tab terminals (terminals) 22 press-fitted into a base portion 20*a* are provided projectingly inside this hood portion 21. Further, a recessed portion 23 is formed at a central position on an upper wall of the hood portion 21 opposing the aforementioned three engaging projections 11. Two guide ribs 24 are integrally formed projectingly in this recessed portion 23, and the three insertion grooves 25, through which the engaging projections 11 are inserted, are respectively provided between the recessed portion 23 and each of the guide ribs 24. Further, two pairs of guide grooves 26, into which the two pairs of leg portions 13 on both sides of the bottom surface of the male connector housing 10, are respectively formed on both sides of the lower wall side of the hood portion 21.

Figure 7:
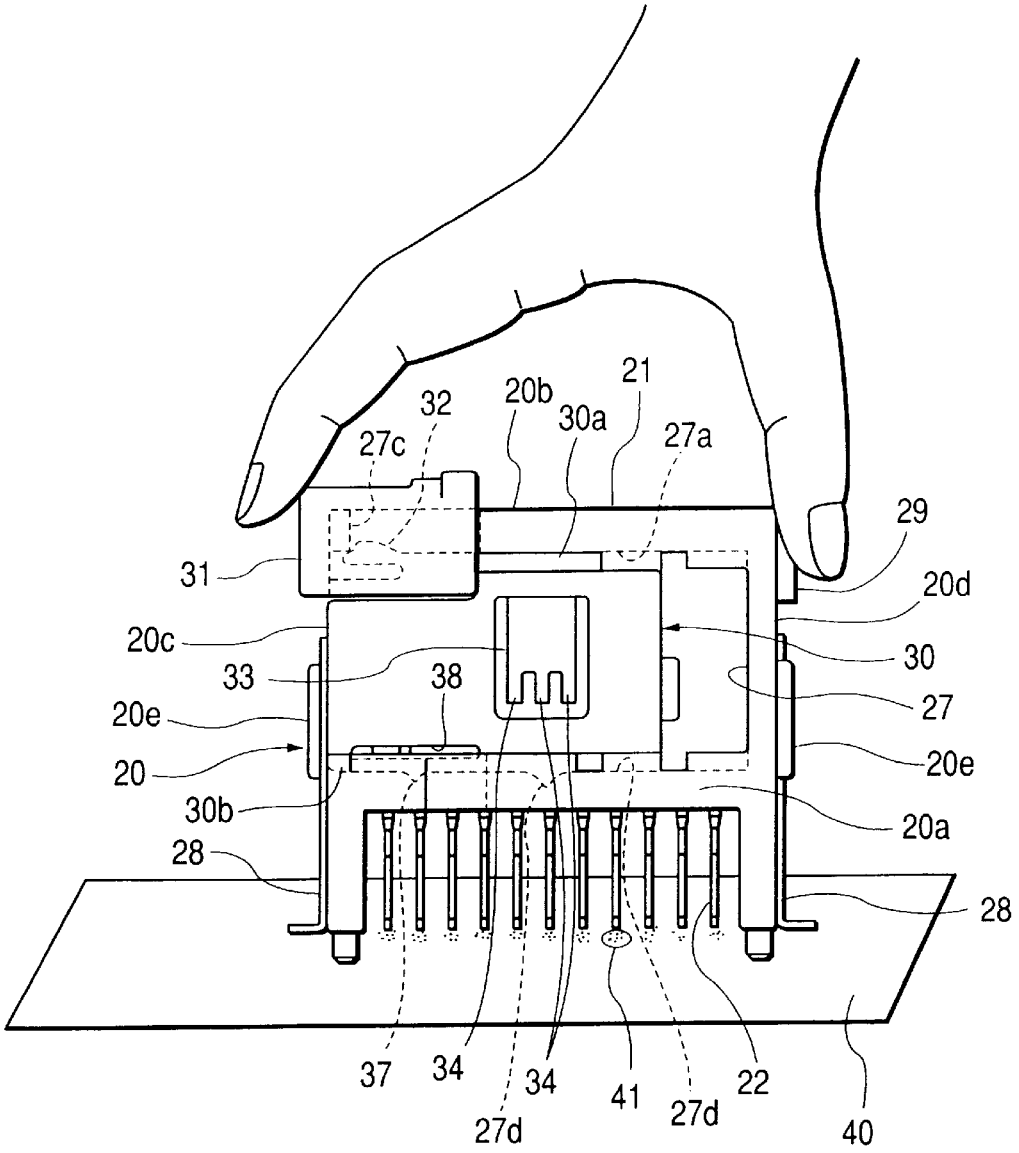
FIG. 7 is a plan view of the female connector housing of the present invention.
Figure 9:
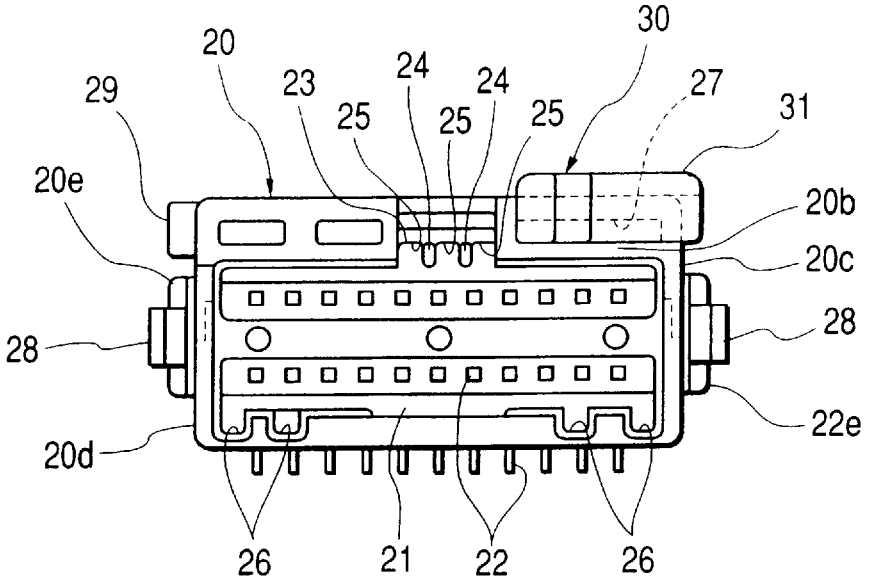
FIG. 9 is a front elevational view of the female connector housing of the present invention.
Figure 10:
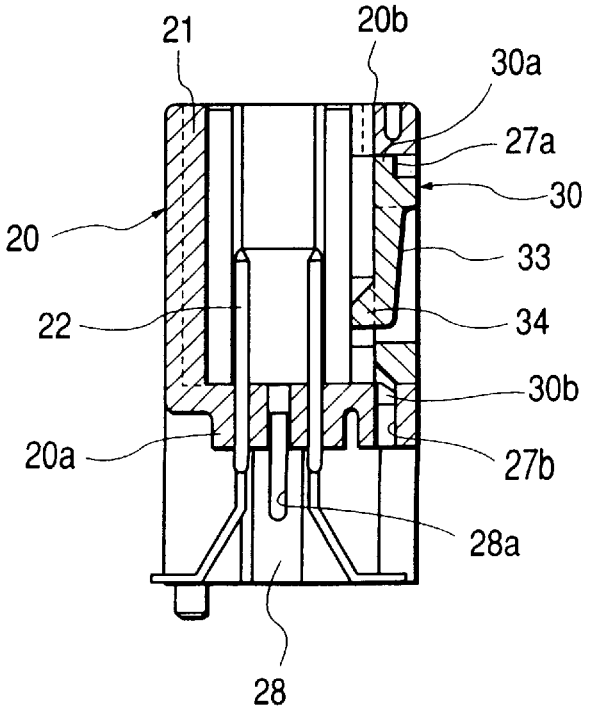
FIG. 10 is a cross-sectional view of the female connector housing of the present invention.

As shown in FIG. 7, a rectangular opening 27 is formed on the flat surface side of the female connector housing 20, and a pair of U-shaped guide grooves 27*a* and 27*b* are formed at upper and lower edges of the opening 27. A quadrangular tubular guide groove 27*c* is formed on the upper side at one end (on the upper left side in FIG. 7) of the upper guide groove 27*a* in such a manner as to communicate with the guide groove 27*a*. In addition, an engaging recessed portion (engaging portion) 27*d* which is recessed in the shape of an inverse triangular prism is formed in the center of the lower guide groove 27*b*. Further, left and right side surfaces 20*c* and 20*d* of the female connector housing 20 have lengths equivalent to those of the male tab terminals 22 and extend to the lower side, and a pair of bracket portions 20*e* are respectively formed integrally in a projecting manner at the centers of the side surfaces 20*c*. Fixing metal fittings 28 having shapes of L-shaped plates each having an elongated hole 28*a* in the center are provided in the pair of bracket portions 20*e* in such a manner as to be capable of being raised or lowered.

Figure 12A:
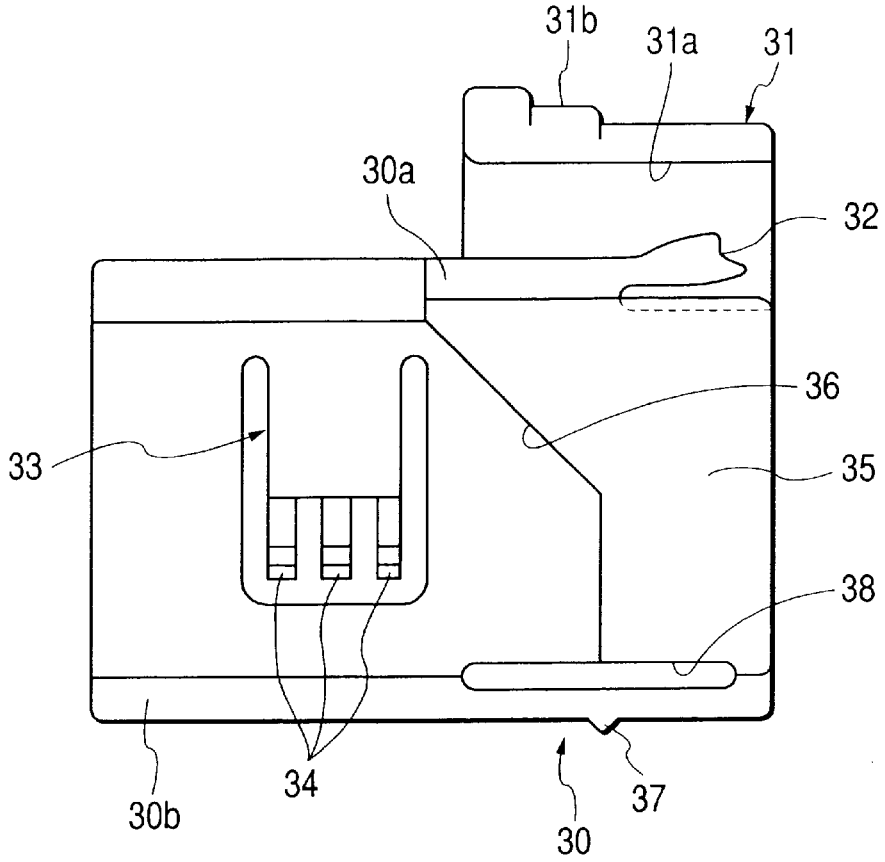
FIG. 12(*a*) is a view, taken from the inner side, of the slide member fitted in the female connector housing of the present invention.
Figure 12B:
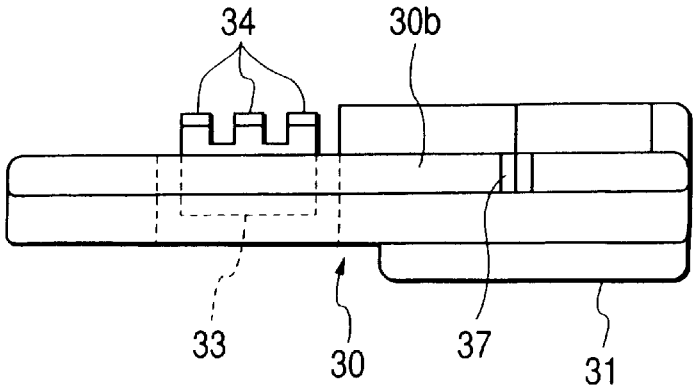
Figure 13:
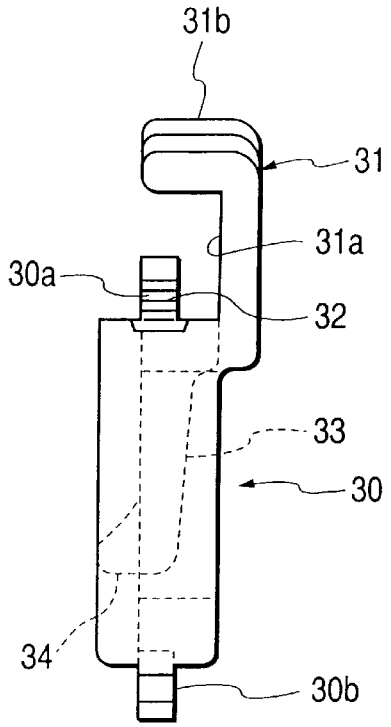
FIG. 13 is a side elevational view of the slide member of the present invention.
Figure 14:
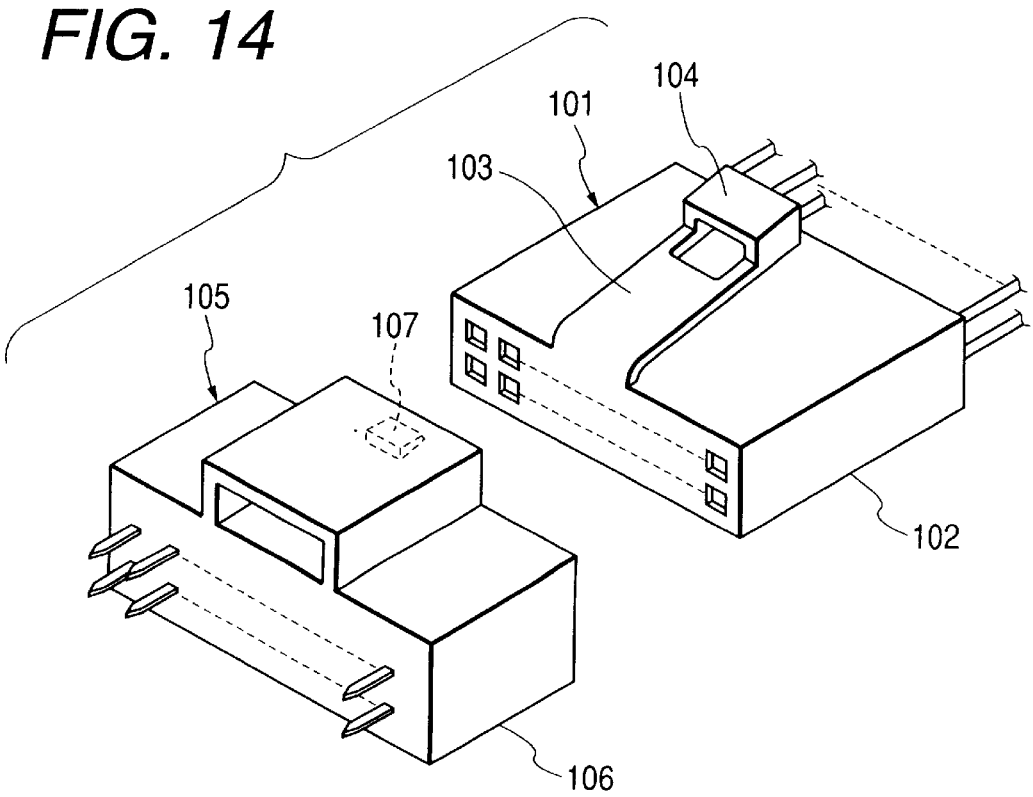
FIG. 14 is an exploded perspective view of a conventional connector locking structure.

As shown in FIGS. 7, 12, and 13, the slide member 30 is formed of a synthetic resin into the shape of a substantially rectangular plate, and its rail portions 30*a* and 30*b* at the centers of its upper and lower end faces are respectively supported slidably by the upper and lower guide grooves 27*a* and 27*b* of the opening 27 in the female connector housing 20. In addition, the operating portion 31 having a U-shaped side surface is integrally formed projectingly on the left end side in FIG. 7 of the upper rail portion 30*a*. A U-shaped guide groove 31*a* for supporting the operated pressing force of the operating portion 31 by an upper end face (one face) 20*b* of the female connector housing 20 and its flat surface side is provided on the inner side of the operating portion 31. This U-shaped guide groove 31*a* is slid along the upper end face 20*b* and flat surface of the female connector housing 20. In addition, a retaining projection 32 serving as a detent is integrally formed projectingly at the center of the lower surface (a portion of the upper rail portion 30*a*) of the guide groove 31*a* of the operating portion 31, and the retaining projection 32 serving as the detent is inserted in the tubular guide groove 27*c* provided on the upper end face 20*b* side of the female connector housing 20, so as to prevent the slide member 30 from coming off.

In addition, a flexible lock arm 33 is provided substantially in the center of the slide member 30 through a U-shaped notch. The three flexible retaining projections 34 in the number corresponding to the number of the engaging projections 11 are respectively provided on the distal end side of the lock arm 33. Further, the portion between the lock arm 33 and the retaining projection 32 serving as the detent for the slide member 30 is formed with a greater thickness than other portions, and a tapered surface 36 which is inclined 45 degrees is provided in this thick portion 35 at a position close to the lock arm 33. As the engaging projections 11 of the male connector housing 10 ride over the flexible retaining projections 34 of the slide member 30, the male connector housing 10 is fitted in the hood portion 21 of the female connector housing 20.

Further, a triangular prism-shaped retaining projection (retaining portion) 37, which is retained by and disengaged from the engaging recessed portion 27*d* of the female connector housing 20, is integrally formed projectingly on the lower rail portion 30*b* of the slide member 30 at a position opposing the operating portion 31. The portion of the retaining projection 37 is adapted to undergo elastic deformation through an elongated hole 38 formed in parallel to the lower rail portion 30*b*. In addition, the upper surface of the operating portion 31 of the slide member 30 serves as an operating surface 31*b* formed as a stepped portion. An end face of the operating portion 31 of the slide member 30 is provided so as to project from the left side surface (one side surface) 20*c* of the female connector housing 20, and a holding portion 29 is integrally formed projectingly on the right side surface (the other side surface) of the female connector housing 20.

A description will be given of the fitting action and the like of the connector locking structure thus constructed. As shown in FIG. 6, if the male connector housing 10 is inserted into the hood portion 21 of the female connector housing 20, the engaging projections 11 of the male connector housing 10 are inserted through the respective insertion grooves 25 in the hood portion 21. Subsequently, the three engaging projections 11 of the male connector housing 10 ride over the three flexible retaining projections 34 of the lock arm 33 of the slide member 30, and the male connector housing 10 is thereby fitted in the hood portion 21 of the female connector housing 20.

In a case where this fitted (locked) state is canceled, if the slide member 30 is moved in a predetermined direction by a predetermined amount, the aforementioned fitted state can be canceled. In addition, as the male connector housing 10 is manually pulled out from inside the hood portion 21 of the female connector housing 20, the engaging projections 11 of the male connector housing 10 abut against the tapered surface 36 of the slide member 30, and the slide member 30 is pushed out to the left side surface 20*c* side of the female connector housing 20 and automatically returns to its initial position, thereby cancelling the aforementioned fitted state. For this reason, even in a case where the male connector housing 10 is fitted in the female connector housing 20 in which the male tab terminals 22 are soldered to a substrate 40, stresses, cracks, or the like do not occur in soldered portions 41 formed between the male tab terminals 22 of the female connector housing 20 and the substrate 40.

Second Embodiment

It should be noted that the same component parts as those of the lock mechanism of a connector of the first embodiment shown in FIGS. 6 to 13 are denoted by the same reference numerals, and a description thereof will be omitted.

As shown in FIG. 1, a canceling projection 14, which is adapted to slide on a tapered surface 36, is integrally formed projectingly on an upper surface 10*a* of a male connector housing 10 at a position close to fitting/locking engaging projections 11 opposing a connector-disengaging tapered surface 36 of a slide member 30. This canceling projection 14 is substantially shaped in the form of a triangular prism, and a tapered surface 15, which slides while coming into surface contact with the tapered surface 36 of the slide member 30, is formed at a position opposing the tapered surface 36 of the slide member 30 in such a manner as to assume substantially the same angle of inclination as that of the tapered surface 36 of the slide member 30. Namely, the tapered surface 15 of the canceling projection 14 of the male connector housing 10 and the connector-disengaging tapered surface 36 of the slide member 30 are respectively formed in such a manner as to be parallel to each other.

In addition, as shown in FIG. 1, a recessed portion 29, through which the canceling projection 14 of the male connector housing 10 is inserted, is formed in a hood portion 21 of a female connector housing 20 at a position close to a recessed portion 23 having three insertion grooves 25.

Figure 3A:
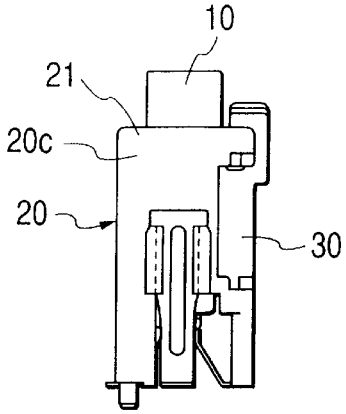
FIG. 3(*a*) is a side elevational view of the two connector housings at the time of fitting.
Figure 3B:
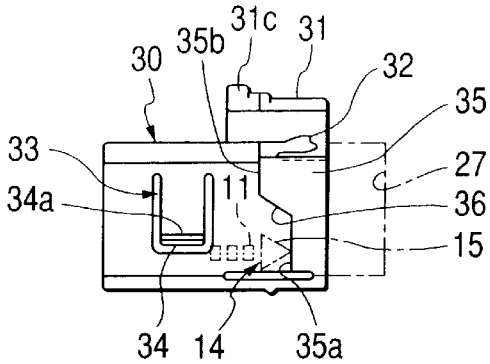

Further, as shown in FIG. 3(*b*), a flexible lock arm 33 is provided substantially in the center of the slide member 30 through a U-shaped notch. One flexible retaining projection 34 for simultaneously engaging (locking) the three engaging projections 11 is provided at the distal end side of the lock arm 33. Further, the portion between a lock arm 33 and a retaining projection 32 serving as a detent for the slide member 30 is formed with a greater thickness than other portions, and the connector-disengaging tapered surface 36 which is inclined 45 degrees is provided in this thick portion 35 at a position close to the lock arm 33. A vertical lower surface 35*a*, against which an apex portion of a lower end of the tapered surface 15 of the canceling projection 14 abuts, is formed on the thick portion 35 below the tapered surface 36 of the slide member 30. Further, a vertical upper surface 35*b*, against which the apex portion of the lower end of the tapered surface 15 of the canceling projection 14 abuts, is formed on the thick portion 35 above the tapered surface 36 of the slide member 30. Incidentally, as shown in FIG. 1, a notch 31*c* for avoiding interference with the canceling projection 14 is formed on the inner side of a step-shaped operating surface 31*b* of an operating portion 31 of the slide member 30.

Figure 2A:
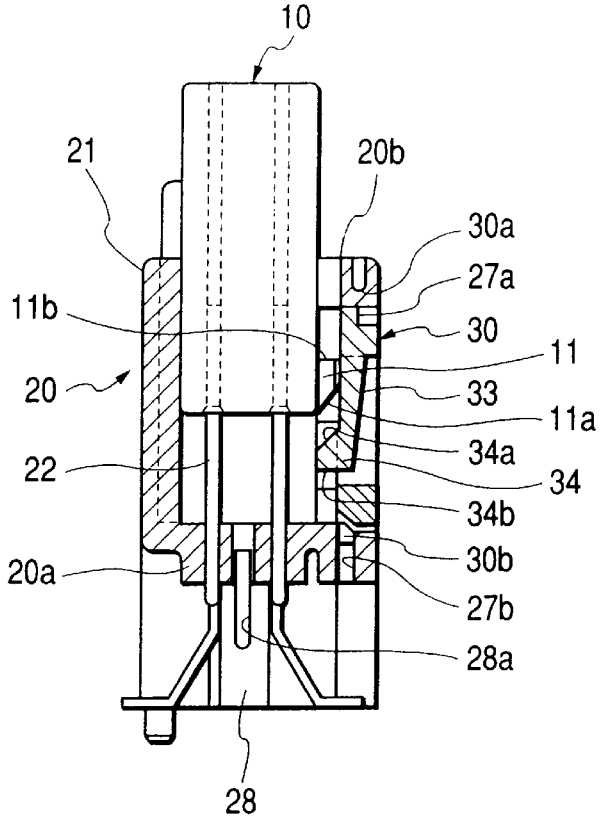
FIG. 2(*a*) is a cross-sectional view of the two connector housings before fitting.
Figure 2B:
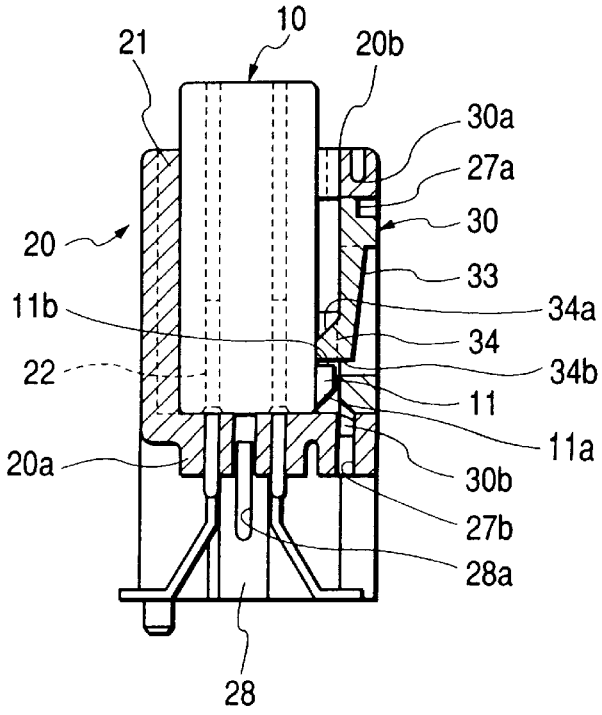

In addition, as shown in FIG. 2(*a*), an inclined guide face 34*a* for guiding front-side inclined surfaces 11*a* of the engaging projections 11 is formed on the inner side (hood portion 21 side) of the flexible retaining projection 34. Further, as shown in FIG. 2(*b*), a distal end face 34*b* of the flexible retaining projection 34 is adapted to retain rear-side inversely inclined surfaces 11*b* of the engaging projections 11.

With the connector locking structure in accordance with the above-described embodiment, as shown in FIG. 1, if the male connector housing 10 is inserted into the hood portion 21 of the female connector housing 20, the fitting/locking engaging projections 11 of the male connector housing 10 are inserted through the respective insertion grooves 25 in the hood portion 21. At the same time, the canceling projection 14 is inserted through the recessed portion 29 in the hood portion 21. Next, as shown in FIG. 2(*a*), if the male connector housing 10 is further inserted in the hood portion 21 of the female connector housing 20, the inclined surfaces 11*a* of the fitting/locking engaging projections 11 of the male connector housing 10 slide along the inclined guide face 34*a* of the flexible retaining projection 34 of the slide member 30.

Consequently, the flexible lock arm 33 is deflected outward, and at the time when the two connector housings

10 and 20 are fitted 20 to each other as shown in FIG. 2(*b*), the three fitting/locking engaging projections 11 of the male connector housing 10 are respectively locked by the distal end face 34*b* of the flexible retaining projection 34 of the lock arm 33. Then, the locked state of the engaging projections 11 of the male connector housing 10 and the retaining projection 34 of the slide member 30 is canceled if the operating portion 31 of the slide member 30 is operated by being pressed toward a right side surface 20*d* of the female connector housing 20.

Figure 4A:
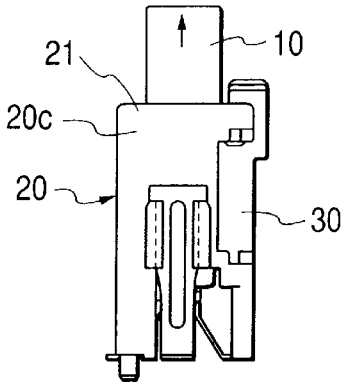
FIG. 4(*a*) is a side elevational view immediately before disengagement of the two connector housings.
Figure 4B:
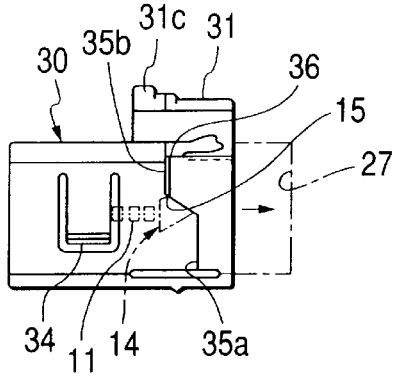
Figure 5A:
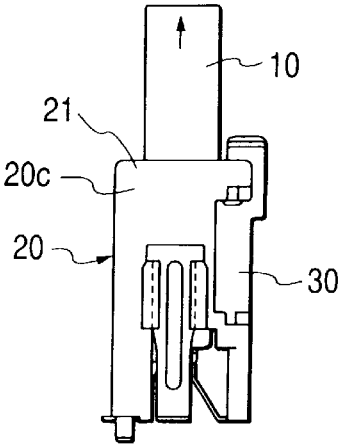
FIG. 5(*a*) is a side elevational view of the two connector housings in the process of disengagement.
Figure 5B:
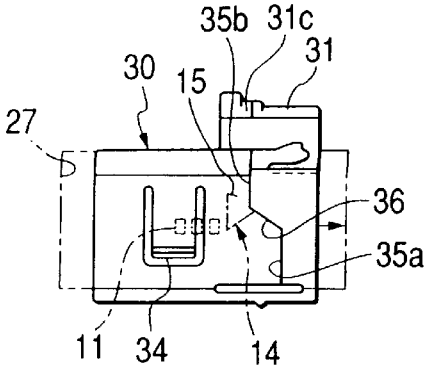

In a case where the fitted state of the two connector housings is canceled, as shown in FIGS. 4(*a*) and 5(*a*), the male connector housing 10 is manually pulled out from inside the hood portion 21 of the female connector housing 20. Consequently, the tapered surface 15 of the canceling projection 14 of the male connector housing 10 abuts against the connector-disengaging tapered surface 36 of the slide member 30, and the canceling projection 14 of the male connector housing 10 pushes out the slide member 30 toward a left side surface 20*c* of the female connector housing 20 by means of the tapered surface 15 as shown in FIGS. 4(*b*) and 5(*b*). When the tapered surface 15 of the canceling projection 14 of the male connector housing 10 has completely left the connector-disengaging tapered surface 36 of the slide member 30, the slide member 30 automatically returns to its initial position.

Thus since the canceling projection 14, which is adapted to slide on the connector-disengaging tapered surface 36 of the slide member 30, is integrally formed projectingly at a position close to the fitting/locking engaging projections 11 of the male connector housing 10, when the male connector housing 10 is disengaged from inside the hood portion 21 of the female connector housing 20, no load is imposed on the fitting/locking engaging projections 11 of the male connector housing 10, so that the fitting/locking engaging projections 11 are prevented from becoming damaged. In addition, since the tapered surface 15, which slides in a state of surface contact with the connector-disengaging tapered surface 36 of the slide member 30, the operationality in returning the slide member 30 can be improved, and the male connector housing can be smoothly disengaged from inside the hood portion 21 of the female connector housing 20.

As described above, in accordance with the present invention, since the canceling projection which is slid on the connector-disengaging tapered surface of the slide member is provided on the male connector housing at a position close to the fitting/locking engaging projections, when the male connector housing is disengaged from the hood portion of the female connector housing, damage to the fitting/locking engaging projections of the male connector housing can be prevented reliably.

In accordance with the present invention, since the tapered surface which slides while coming into surface contact with the connector-disengaging tapered surface of the slide member is formed on the canceling projection of the male connector housing, the operationality in returning the slide member can be improved, and the male connector housing can be smoothly disengaged from inside the hood portion of the female connector housing.

What is claimed is:

1. A connector locking structure comprising:

engaging projections provided on a male connector housing;

insertion grooves, through which said engaging projections are inserted, provided in a hood portion of a female connector housing with respect to which said male connector housing is engaged and disengaged;

a slide member having a flexible retaining projection engaging with said engaging projections, said slide member being provided on said hood portion of said female connector housing in such a manner as to be movable by a pressing operation of an operating portion, so as to lock a fitted state of said two connector housings by engagement between said flexible retaining projection of said slide member and said engaging projections of said male connector housing;

a connector-disengaging tapered surface provided on said slide member; and a canceling projection slid on said tapered surface, said canceling projection being provided on said male connector housing at a position opposing said tapered surface.

2. A connector locking structure according to claim 1, further comprising:

an auxiliary tapered surface slidingly coming into surface contact with said tapered surface of said slide member, said auxiliary tapered surface formed on said canceling projection at a position opposing said tapered surface of said slide member at substantially the same angle of inclination as that of said tapered surface of said slide member.

* * * * *